US008350640B2

(12) United States Patent
Shen

(10) Patent No.: US 8,350,640 B2
(45) Date of Patent: Jan. 8, 2013

(54) TRANSCEIVER MODULE FOR SATELLITE ANTENNA

(75) Inventor: Wen-Chao Shen, Bade (TW)

(73) Assignee: Azure Shine International Inc., Taoyuan (TW)

( * ) Notice: Subject to any disclaimer, the term of this patent is extended or adjusted under 35 U.S.C. 154(b) by 857 days.

(21) Appl. No.: 12/453,472

(22) Filed: May 12, 2009

(65) Prior Publication Data

US 2010/0085246 A1 Apr. 8, 2010

(30) Foreign Application Priority Data

Oct. 3, 2008 (TW) ..... 97138252 A

(51) Int. Cl.
*H01P 5/16* (2006.01)

(52) U.S. Cl. ..... 333/126; 333/137; 333/129; 333/135

(58) Field of Classification Search ..... 333/125, 333/127, 21 A, 208, 136, 137, 126, 129, 135
See application file for complete search history.

(56) References Cited

U.S. PATENT DOCUMENTS 3,597,710 A * 8/1971 Levy ..... 333/210
5,578,972 A * 11/1996 Hadden et al. ..... 333/135
6,560,850 B2 * 5/2003 St. John et al. ..... 29/600

* cited by examiner

*Primary Examiner* — Benny Lee
*Assistant Examiner* — Gerald Stevens
(74) *Attorney, Agent, or Firm* — Stites & Harbison, PLLC; Juan Carlos A. Marquez, Esq; Nicholas B. Trenkle

(57) ABSTRACT

A transceiver module for a satellite antenna comprises a base and a cover. The base includes a transducer extending between a first end plate and a second end plate in a first direction, a first filter portion including a number or first grooves extending in the first direction and arranged along a second direction orthogonal to the first direction, and a waveguide to guide signals toward a third end plate. The cover serves as a second filter portion for the transceiver module and includes a number of second grooves arranged along the second direction. The base includes the transducer, the first filter portion and the waveguide as an integral member.

19 Claims, 6 Drawing Sheets

TRANSCEIVER MODULE FOR SATELLITE ANTENNA

CROSS REFERENCE TO RELATED APPLICATION

This application claims the benefit of an R.O.C. Application No. 097138252 filed Oct. 3, 2008.

BACKGROUND OF THE INVENTION

The present invention relates generally to satellite communications and, more particularly, to transceiver modules for satellite antennae.

Satellite communications systems have been widely deployed over the past decades. Some systems, for example, global positioning systems (GPS) for navigation and satellite news gathering (SNG) systems for live broadcast of news, have been increasingly used to provide a variety of services in our daily lives. In satellite communications, a transceiver may generally be used to process incoming and outgoing signals.

FIG. 1 is a perspective view of a conventional transceiver 10 and a block up-converter (BUC) 20. Referring to FIG. 1, the transceiver 10 may include an orthogonal mode transducer (OMT) 11, a waveguide 12 and a filter 13. The OMT 11, waveguide 12 and filter 13 are discrete components and may be mechanically coupled together by fastening elements 14 through, for example, bolt joints or rivet joints. The manufacturing factor and process of coupling may affect the quality of the transceiver 10. For example, manufacturing tolerance each of the OMT 11, waveguide 12 and filter 13 may result in imprecision in coupling these separate components 11, 12 and 13. Moreover, deviation in the relative position of these components 11, 12 and 13 due to a manual coupling process may further deteriorate the quality of the transceiver 10. Furthermore, after coupled, the filter 13 with an outlet 131 may protrude over an inlet 121 of the waveguide 12 and thus may put the inlet 121 in an awkward position in its coupling with the BUC 20. Specifically, the outlet 131 may interfere with the coupling of the BUC 20 to the inlet 121. It may therefore be desirable to have a transceiver that may alleviate the coupling issues.

BRIEF SUMMARY OF THE INVENTION

Examples of the present invention may provide a transceiver module for a satellite antenna that comprises a base and a cover. The base includes a transducer extending between a first end plate and a second end plate in a first direction, a first filter portion including a number or first grooves extending in the first direction and arranged along a second direction orthogonal to the first direction, and a waveguide to guide signals toward a third end plate. The cover serves as a second filter portion for the transceiver module and includes a number of second grooves arranged along the second direction. The base includes the transducer, the first filter portion and the waveguide as an integral member.

Some examples of the present invention may also provide a transceiver module for a satellite antenna. The transceiver module comprises a base constructed as one integral portion of the transceiver module, and a second filter portion constructed as the other one integral portion of the transceiver module. The base includes a transducer extending in a first direction, a waveguide, and a first filter portion extending between a first side and a second side thereof in a second direction orthogonal to the first direction. The first filter portion is coupled with the transducer at the first side and coupled with the waveguide at the second side. Furthermore, the second filter portion extends in the second direction.

Examples of the present invention may further provide a transceiver module for a satellite antenna. The transceiver module comprises a transducer extending between a first end plate and a second end plate thereof in a first direction and having an inlet at the second end plate, a waveguide including a third end plate and having an outlet at the third end plate, and a filter extending between a first side and a second side thereof in a second direction orthogonal to the first direction. The first filter portion is coupled with the transducer at the first side and is coupled with the waveguide at the second side. The center to center distance between the inlet and the outlet is equal to or greater than the distance between the first side and second side of the filter.

Other objects, advantages and novel features of the present invention will be drawn from the following detailed embodiments of the present invention with attached drawings, in which:

BRIEF DESCRIPTION OF THE SEVERAL VIEWS OF THE DRAWINGS

The foregoing summary as well as the following detailed description of the preferred examples of the present invention will be better understood when read in conjunction with the appended drawings. For the purposes of illustrating the invention, there are shown in the drawings examples which are presently preferred. It is understood, however, that the invention is not limited to the precise arrangements and instrumentalities shown. In the drawings.

DETAILED DESCRIPTION OF THE INVENTION

Reference will now be made in detail to the present examples of the invention illustrated in the accompanying drawings. Wherever possible, the same reference numbers will be used throughout the drawings to refer to the same or like portions. It should be noted that the drawings are made in simplified form and are not drawn to precise scale.

Figure 2:
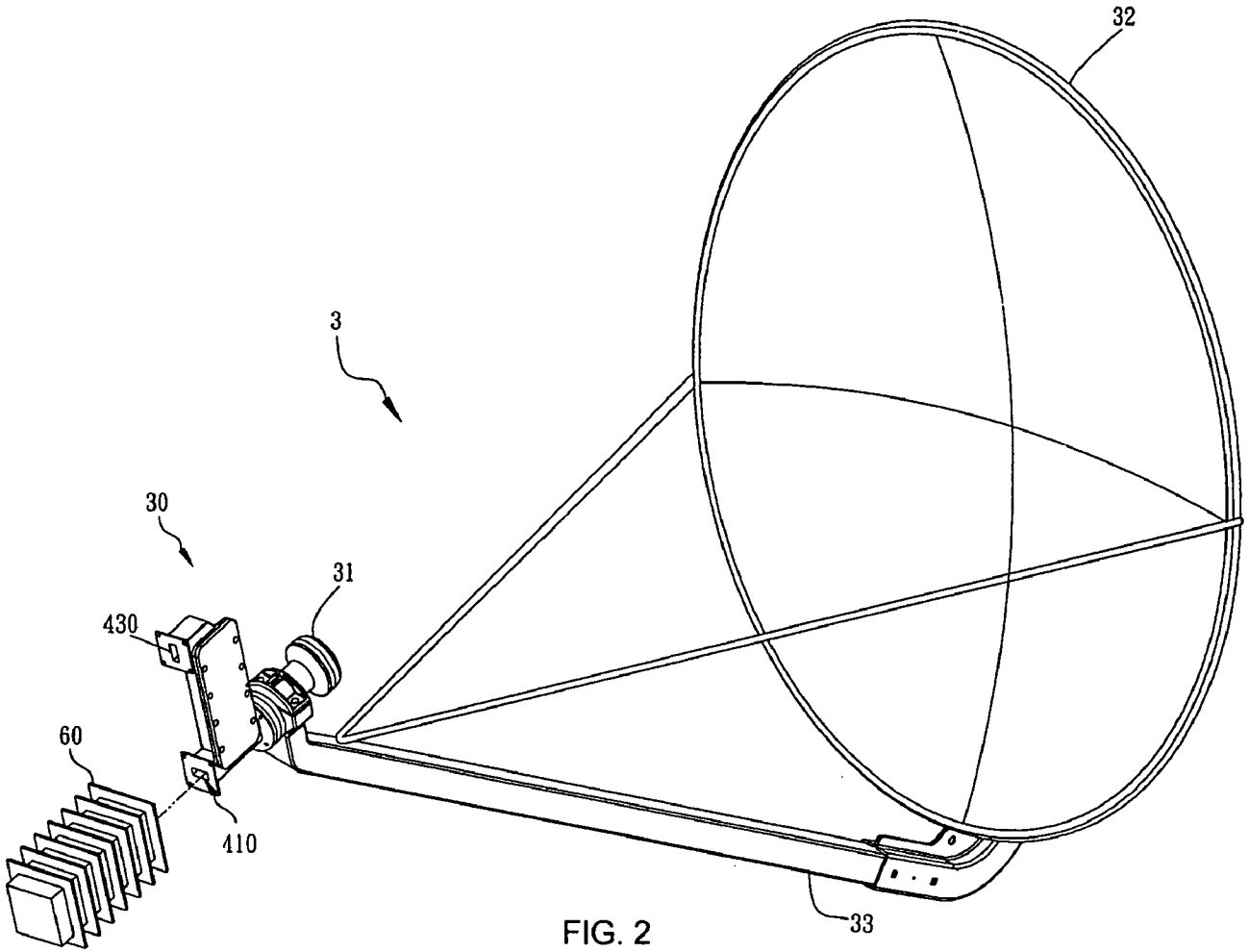
FIG. 2 is a left front isometric view of a satellite antenna in accordance with an example of the present invention.

FIG. 2 is a left front isometric view of a satellite antenna 3 in accordance with an example of the present invention. Referring to FIG. 2, the satellite antenna 3 may include a transceiver module 30, a feed horn 31 and an antenna dish 32. The transceiver module 30 and the feed horn 31 may be coupled to each other and together held by a supporting arm 33 in front of the antenna dish 32. The transceiver module 30 may be further coupled with a block up-converter (BUC) 60. The antenna dish 32 can reflect and transmit satellite signals and may generally take the form of a parabolic configuration to facilitate the collection of signals dispersed at the dish surface at a focused point in front of the antenna dish 32 where the feed horn 31 is located. In operation, an incoming signal from the antenna dish 32 via the feed horn 31 may be processed in the transceiver module 30 and then sent through an outlet 430 to an electronic device (not shown), for example, a low-noise down-converter (LNB). Furthermore, an outgoing signal from the BUC 60 through an inlet 410 may be processed in the transceiver module 30 and then sent via the feed horn 31 to the antenna dish 32. The structure of the transceiver module 30 will be discussed in detail by reference to FIGS. 3A to 3C in paragraphs below.

Figure 1:
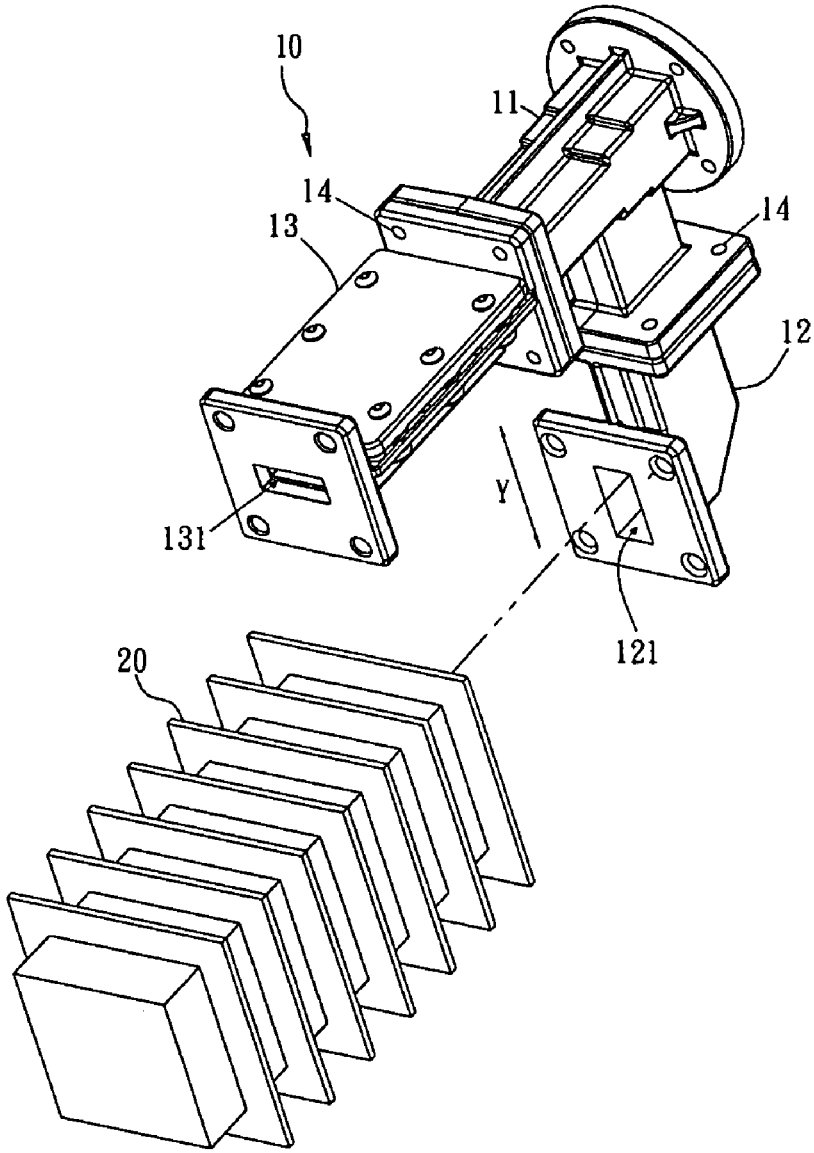
FIG.1 PRIOR ART
FIG. 1 is a perspective view of a conventional transceiver and a block up-converter.
Figure 3A:
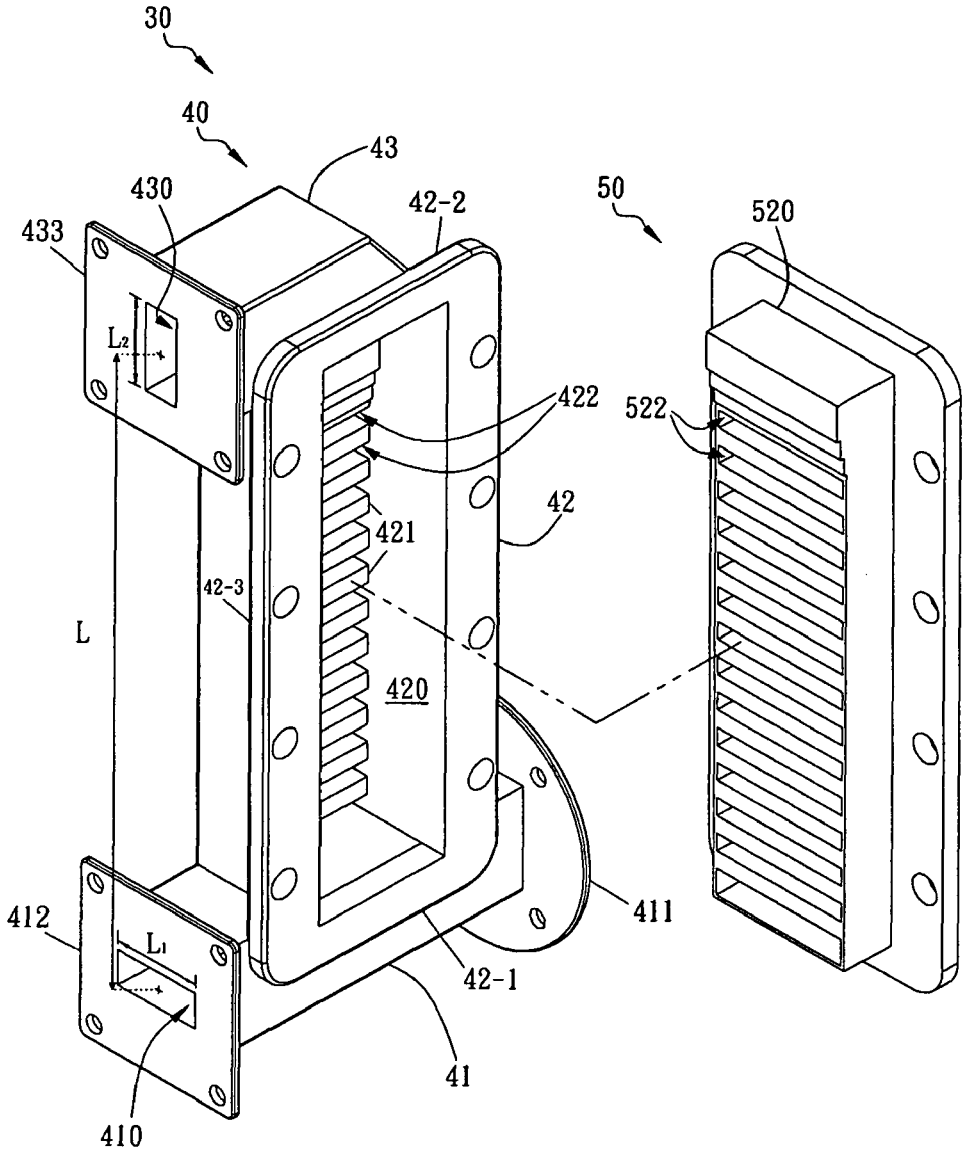
FIG. 3A is a perspective view showing a pre-assemble status of a transceiver module in accordance with an example of the present invention.

FIG. 3A is a perspective view showing a pre-assemble status of the transceiver module 30 in accordance with an example of the present invention. Referring to FIG. 3A, the transceiver module 30 may include a base 40 and a cover 50. The base 40 may further include a transducer 41, a first filter portion 42 and a waveguide 43, which may be molded as an integral portion of the base 40. Accordingly, the base 40 includes the transducer 41, first filter portion 42 and waveguide 43 as an integral, one-piece member. As compared to the transceiver 10 illustrated in FIG. 1, the transceiver module 30 may alleviate the coupling issues because fastening elements required to fasten the transducer, filter and waveguide together are eliminated.

The transducer 41, for example, an orthogonal mode transducer (OMT), may extend in a first direction between the feed horn 31 and the BUC 60 and include a first end plate 411 to couple with the feed horn 31 and a second end plate 412 to couple with the BUC 60.

The first filter portion 42 may include a depressed region 420, wherein a number of ridges 421 and first grooves 422 extending in the first direction may be arranged between a first side 42-1 and a second side 42-2 along a second direction orthogonal to the first direction. The ridges 421 and the first grooves 422 are interleaved with each other. In one example, the first grooves 422 may be arranged at a predetermined interval. Furthermore, the cover 50, which is an integral, one-piece member and serves as a second filter portion corresponding to the first filter portion 42, may include a raised region 520 corresponding to the depressed region 420. A number of second grooves 522 in the raised region 520 may be arranged at the same predetermined interval along the second direction.

The waveguide 43, which is constructed to guide signals in a desired direction to the LNB (not shown), may include a third end plate 433 to facilitate coupling between the waveguide 43 and the LNB. The inlet 410 at the second end plate 412 may have a rectangular profile with a first length $L_1$ extending in a third direction substantially orthogonal to the first and second directions. Moreover, the outlet 430 at the third end plate 433 may have a rectangular profile with a second length $L_2$ extending in the second direction.

In the present example, the second end plate 412 and third end plate 433 are disposed near a third side 42-3 of the filter 42. Furthermore, the second end plate 412 and third end plate 433 may be flush with each other. The inlet 410 and the outlet 430 may be disposed near the first side 42-1 and the second side 42-2, respectively, and may thus be separated from each other by a sufficient distance. For example, the center to center distance "L" may be equal to or greater than the full length of the first filter portion 42 between the opposed first and second sides 42-1 and 42-2. Accordingly, the third end plate 433 may not interfere with the coupling of the BUC 60 to the second end plate end 412.

At least one of the base 40 or cover 50 may include an alloy of aluminum (Al) and zinc (Zn), wherein the weight percentage of zinc is greater than that of aluminum. In one example, the weight percentage of zinc is equal to or greater than approximately 90%. In another example, the weight percentage of zinc is equal to or smaller than approximately 99%. In still another example, the weight percentage of aluminum is equal to or greater than approximately 1%. In yet another example, the weight percentage of aluminum is equal to or smaller than approximately 10%. In yet still another example, the alloy may include approximately 90% to 99% of zinc and approximately 1% to 10% of aluminum by weight.

Figure 3B:
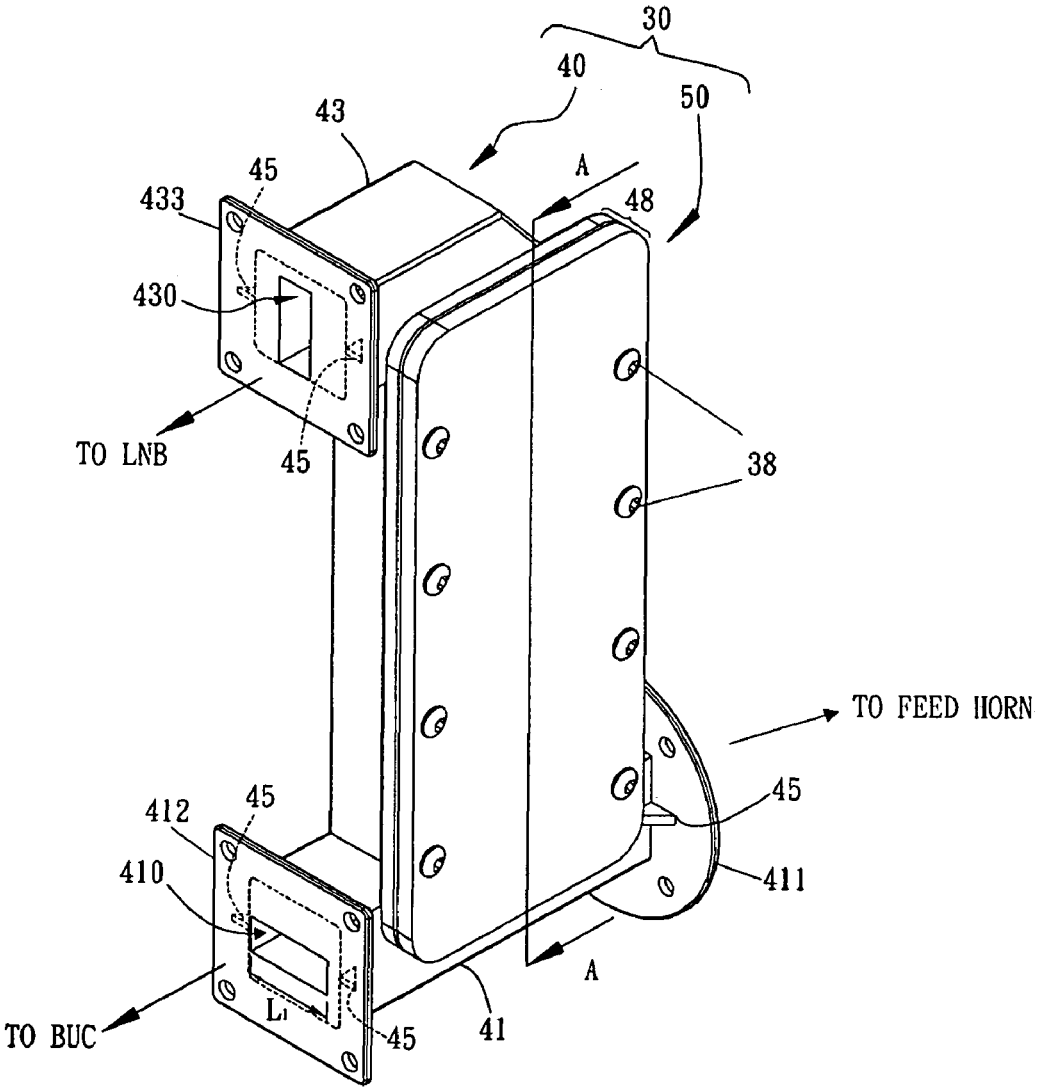
FIG. 3B is a perspective view showing an assembled status of the transceiver module illustrated in FIG. 3A.

FIG. 3B is a perspective view showing an assembled status of the transceiver module 2 illustrated in FIG. 3A. Referring to FIG. 3B, the base 40 and the cover 50 may be secured to each other by fastening elements 38 so that a filter 48 composed of the filter portion 42 and the cover 50, i.e., the second filter portion is formed. The transducer 41 may isolate incoming signals from outgoing signals. Specifically, incoming signals from the feed horn 31 and outgoing signals from the BUC 60 may be orthogonal to each other in polarity so that the transducer 41 may receive incoming signals and transmit outgoing signals at the same time. In operation, also referring to FIG. 2, an incoming signal from the antenna dish 32 via the feed horn 31 may be received in the transducer 41, processed in the filter 48 and then guided by the waveguide 43 through the outlet 430 to the LNB. Furthermore, an outgoing signal from the BUC 60 may be received through the inlet 410 by the transducer 41 and then sent via the feed horn 31 to the antenna dish 32.

The base 40 may further include support blocks 45 integrally formed with the base 40. The support blocks 45 may be disposed at the rear of and may abut against at least one of the first, second or third end plate 411, 412 or 433 to prevent these end plates from deformation due to mechanical stresses resulting from their coupling with the feed horn 31, BUC 60 or LNB, respectively.

Figure 3C:
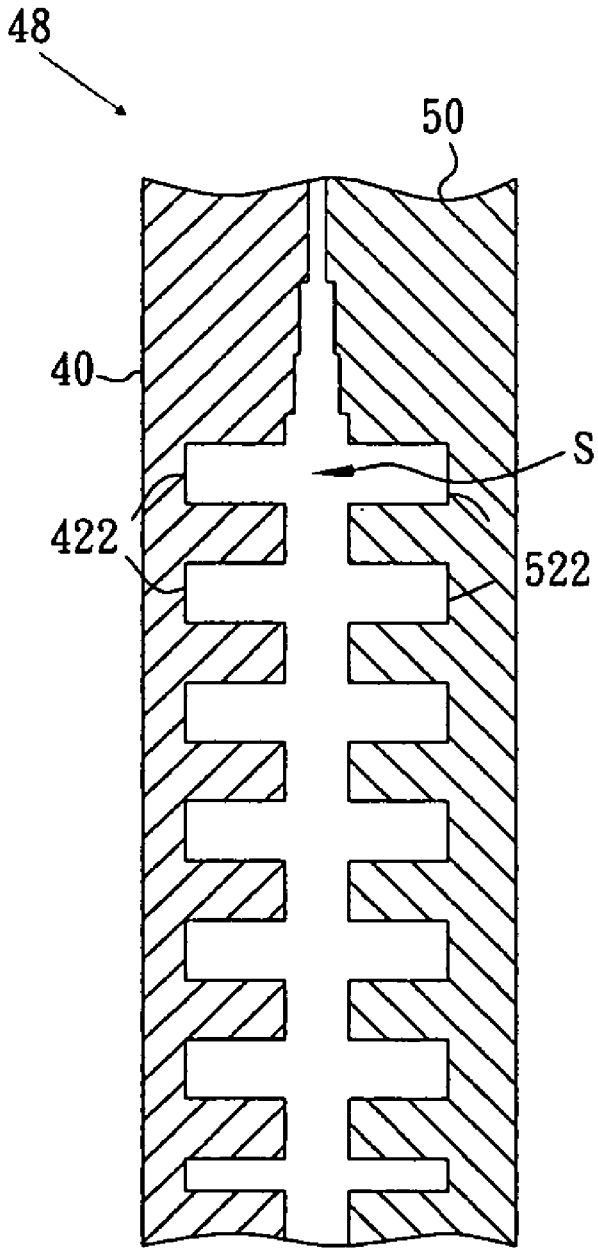
FIG. 3C is a cross-sectional view of a filter of the transceiver module illustrated in FIG. 3B taken along line A-A.

FIG. 3C is a cross-sectional view of the filter 48 of the transceiver module 30 illustrated in FIG. 3B taken along line A-A. Referring to FIG. 3C, the first grooves 422 of the base 40 and the second grooves 522 of the cover 50 may be aligned with each other and together define a filter space "S" therein. When signals travel in the filter space "S", those at a desired frequency range may pass the filter 48 while the remaining may be filtered. As a result, only a portion of the signals from the transducer 41 may be allowed to pass the filter 48 and sent to the LNB via the waveguide 43.

Figure 4:
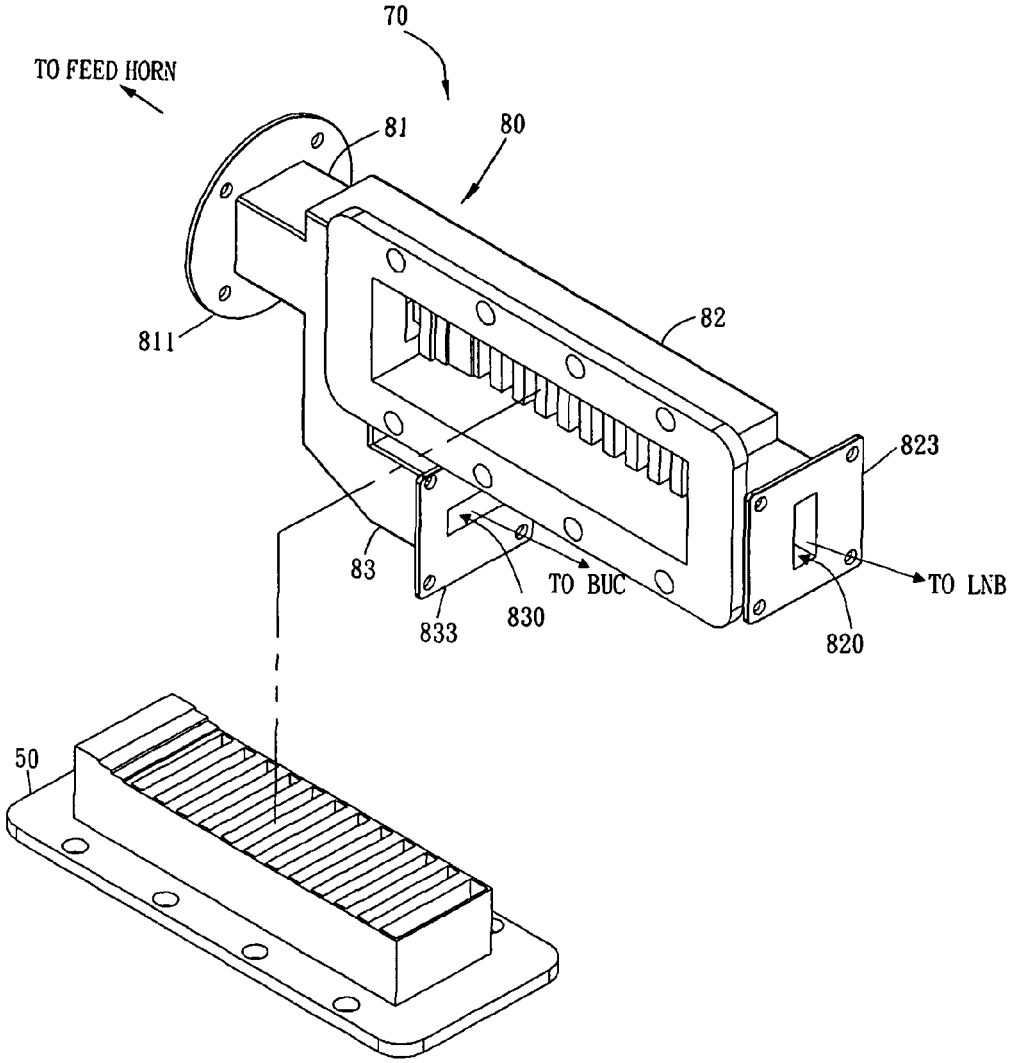
FIG. 4 is a perspective view showing a pre-assemble status of a transceiver module in accordance with another example of the present invention.

FIG. 4 is a perspective view showing a pre-assemble status of a transceiver module 70 in accordance with another example of the present invention. Referring to FIG. 4, the transceiver module 70 may be similar to the transceiver module 30 described and illustrated with reference to FIG. 3A except a base 80. The base 80 may include a transducer 81, a first filter portion 82 and a waveguide 83, which may be respectively similar in function to the transducer 41, first filter portion 42 and waveguide 43 in FIG. 3A but are different in arrangement. Furthermore, the base 80 includes the transducer 81, first filter portion 82 and waveguide 83 as an integral, one-piece member. The transducer 81 may include a first end plate 811 to couple with a feed horn. The filter 82 may include a number of ridges 821 and grooves 822 extending in the second direction and arranged between the first end plate 811 and a second end plate 823 along the third direction. The second end plate 823 may facilitate the filter 82 to couple with an LNB. The waveguide 83 may be constructed to couple with a BUC via a third end plate 833.

In operation, an incoming signal from an antenna dish via the feed horn may be received in the transducer 81, processed in a filter composed of the first filter portion 82 and the cover 50, and then sent to the LNB through an outlet 820 at the second end plate 823. Furthermore, an outgoing signal from the BUC may be received through an inlet 830 at the third end plate 833, guided by the waveguide 83 to the transducer 81 and then sent to the feed horn. The inlet 830 has a rectangular profile with a length (not numbered) extending in the second direction, and the outlet 820 has a rectangular profile with a length (not numbered) extending in the third direction.

In describing representative examples of the present invention, the specification may have presented the method and/or process of operating the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

It will be appreciated by those skilled in the art that changes could be made to the examples described above without departing from the broad inventive concept thereof. It is understood, therefore, that this invention is not limited to the particular examples disclosed, but it is intended to cover modifications within the spirit and scope of the present invention as defined by the appended claims.

I claim:

1. A transceiver module for a satellite antenna, the transceiver module comprising:

a base including:

a transducer extending between a first end plate and a second end plate in a first direction;

a first filter portion including a number of first grooves extending in the first direction and arranged along a second direction orthogonal to the first direction; and a waveguide to guide signals toward a third end plate; and a cover to serve as a second filter portion for the transceiver module, the cover including a number of second grooves arranged along the second direction, wherein the base includes the transducer, the first filter portion and the waveguide as an integral member, and wherein the transducer, the first filter portion and the waveguide are constructed as one integral portion of the transceiver module and the second filter portion is constructed as another integral portion of the transceiver module.

2. The transceiver module of claim 1 further comprising an inlet at the second end plate, wherein the inlet has a rectangular profile with a length extending in a third direction orthogonal to the first and second directions.

3. The transceiver module of claim 2 further comprising an outlet at the third end plate, wherein the outlet has a rectangular profile with a length extending in the second direction.

4. The transceiver module of claim 3, wherein a center to center distance between the inlet and the outlet is equal to or greater than the length of the first filter portion in the second direction.

5. The transceiver module of claim 1, wherein the second end plate is disposed near a first side of the first filter portion and the third end plate is disposed near a second side of the first filter portion, the first side and the second side being opposite to each other.

6. The transceiver module of claim 1, wherein the second end plate and the third end plate are flush with each other.

7. The transceiver module of claim 1, wherein the first grooves and the second grooves are aligned with each other in an assembled status of the transceiver module.

8. The transceiver module of claim 1 further comprising at least one support block integrally formed with the base and arranged to abut against at least one of the first, second and third end plates.

9. The transceiver module of claim 1, wherein the first grooves are interleaved with a number of ridges arranged at a predetermined interval.

10. A transceiver module for a satellite antenna, the transceiver module comprising:

a base constructed as one integral portion of the transceiver module, the base including:

a transducer extending in a first direction;

a waveguide; and a first filter portion extending between a first side and a second side thereof in a second direction orthogonal to the first direction, the first filter portion coupled with the transducer at the first side and coupled with the waveguide at the second side; and a second filter portion constructed as another integral portion of the transceiver module, the second filter portion extending in the second direction, wherein the transducer, the-first filter portion and the waveguide are constructed as said one integral portion of the transceiver module and the second filter portion is constructed as another integral portion of the transceiver module.

11. The transceiver module of claim 10, wherein the first filter portion includes a number of first grooves extending in the first direction and arranged along the second direction.

12. The transceiver module of claim 10, wherein the transducer extends between a first end plate and a second end plate thereof.

13. The transceiver module of claim 12, wherein the transducer has an inlet at the second end plate, and wherein the inlet has a rectangular profile with a length extending in a third direction orthogonal to the first and the second directions.

14. The transceiver module of claim 13, wherein the waveguide includes a third end plate and an outlet at the third end plate, and wherein the outlet has a rectangular profile with a length extending in the second direction.

15. The transceiver module of claim 14, wherein a center to center distance between the inlet and the outlet is equal to or greater than a distance between the first side and second side of the first filter portion.

16. The transceiver module of claim 14 further comprising at least one support block integrally formed with the base and arranged to abut against at least one of the first, second and third end plates.

17. A transceiver module for a satellite antenna, the transceiver module comprising:

a transducer extending between a first end plate and a second end plate thereof in a first direction, the transducer having an inlet at the second end plate;

a waveguide including a third end plate and having an outlet at the third end plate; and a filter extending between a first side and a second side thereof in a second direction orthogonal to the first direction, wherein the filter includes a first filter portion and a second filter portion, and the first filter portion being coupled with the transducer at the first side and coupled with the waveguide at the second side, wherein a center to center distance between the inlet and the outlet is equal to or greater than a distance between the first side and the second side of the filter, and wherein the transducer, the first filter portion and the waveguide are constructed as one integral portion of the transceiver module and the second filter portion is constructed as another integral portion of the transceiver module.

18. The transceiver module of claim 17 further comprising at least one support block integrally formed with the transducer, the first filter portion and the waveguide and arranged to abut against at least one of the first, second and third end plates.

19. The transceiver module of claim 17, wherein the first filter portion includes a number of first grooves extending in the first direction and arranged along the second direction, and the second filter portion includes a number of second grooves aligned with the first grooves.

* * * * *